US007518070B2

(12) United States Patent
Garcia-Briz

(10) Patent No.: US 7,518,070 B2
(45) Date of Patent: Apr. 14, 2009

(54) ELECTRICAL SWITCH

(75) Inventor: Alberto Garcia-Briz, Valls (ES)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 11/672,170

(22) Filed: Feb. 7, 2007

(65) Prior Publication Data

US 2008/0185282 A1 Aug. 7, 2008

(51) Int. Cl.
*H01H 25/04* (2006.01)

(52) U.S. Cl. ..... 200/6 A; 200/5 R

(58) Field of Classification Search ..... 200/4, 200/5 R, 6 A, 11 R, 11 A, 14, 11 D, 11 DA, 200/17 R, 18, 517, 329, 333, 336, 339; 341/20, 341/35; 345/156, 157, 160, 161, 168, 169, 345/184

See application file for complete search history.

(56) References Cited

U.S. PATENT DOCUMENTS 4,769,516 A * 9/1988 Allen ..... 200/5 R
4,837,413 A * 6/1989 Schwab et al. ..... 200/11 R
5,039,830 A * 8/1991 Orillard ..... 200/61.39
5,412,164 A * 5/1995 Conway et al. ..... 200/1 B
5,668,359 A * 9/1997 Alvord et al. ..... 200/6 B
5,714,980 A * 2/1998 Niino ..... 345/160
5,819,916 A * 10/1998 Lee ..... 200/557
5,883,346 A * 3/1999 Stocken ..... 200/4
6,037,552 A * 3/2000 Yamada ..... 200/339
6,765,158 B1 7/2004 Morrison et al.
6,816,044 B2 11/2004 Mader et al.
6,927,348 B1 8/2005 Schmidt et al.
6,998,546 B1 2/2006 Schmidt et al.
7,078,641 B2 7/2006 Stack et al.
7,119,290 B2 * 10/2006 Kim ..... 200/5 R
2006/0220893 A1 10/2006 Torrez et al.
2006/0237297 A1 10/2006 Xu

* cited by examiner

*Primary Examiner*—Michael A Friedhofer
(74) *Attorney, Agent, or Firm*—Brooks Kushman P.C.

(57) ABSTRACT

Switches include electrical conductors for the transmission of switch signals. In some embodiments the conductor may include a flexible printed circuit. Alternatively, the conductor may be formed of a molded-interconnect device (MID), wherein portions of the switch include at least one electrical line/track.

19 Claims, 3 Drawing Sheets

ELECTRICAL SWITCH

TECHNICAL FIELD

The embodiments described herein relate to an electrical switch.

BACKGROUND

Conventional electrical switches may include a membrane that is positioned directly on a circuit board such as a printed circuit board (PCB). Portions of the membrane may be designed to close a circuit on the circuit board when engaged (e.g., touched or pressed) by a user. Closing of the circuit allows the flow of current through the switch thereby causing some operation (e.g., energization of an electric motor, processing by a controller and the like) to occur. Although conventional switches are useful, there exists a wide horizon for improvement. Particularly, the conventional switches are typically bulky as a result of a rigid circuit board. Moreover, in some cases, the bulky packaging of conventional switches imposes constraints on electrical switch styling.

The embodiments described herein were conceived in view of these and other disadvantages of convention electrical switches.

SUMMARY

The disclosed embodiments include a switch having a base plate and a conductor being substantially planar with the base plate. The switch also includes a circuit support structure positioned on the base plate in contact with the conductor to enable the flow of current from the circuit support structure to the conductor. A knob may be included that substantially encloses the circuit support structure. The knob may be rotatable about the base plate so as to encircle the circuit support structure during rotation, wherein rotation of the knob enables the transmission of switch signals.

In an alternative embodiment, a switch includes a housing having a bottom wall and at least one side wall being substantially perpendicular with the bottom wall. An electrical conductor may be substantially planar with the side wall. Additionally, an actuator movably located within the housing is configured to traverse the bottom wall of the housing. Additionally, at least one electrical contact may be positioned within the housing so as to contact the side wall to electrically couple the electrical contact to the electrical conductor. Traversal of the bottom wall by the actuator may cause the actuator to contact the electrical contact thereby causing the transmission of a switch signal.

BRIEF DESCRIPTION OF THE DRAWINGS

The novel features of the described embodiments are set forth with particularity in the appended claims. These embodiments, both as to their organization and manner of operation, together with further advantages thereof, may be best understood with reference to the following description, taken in connection with the accompanying drawings in which:

DETAILED DESCRIPTION OF THE EMBODIMENT(S)

As required, detailed descriptions of embodiments are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific functional details disclosed herein are not to be interpreted as limiting, but merely as a representative basis for the claims and/or as a representative basis for teaching one skilled in the art.

Figure 1A:
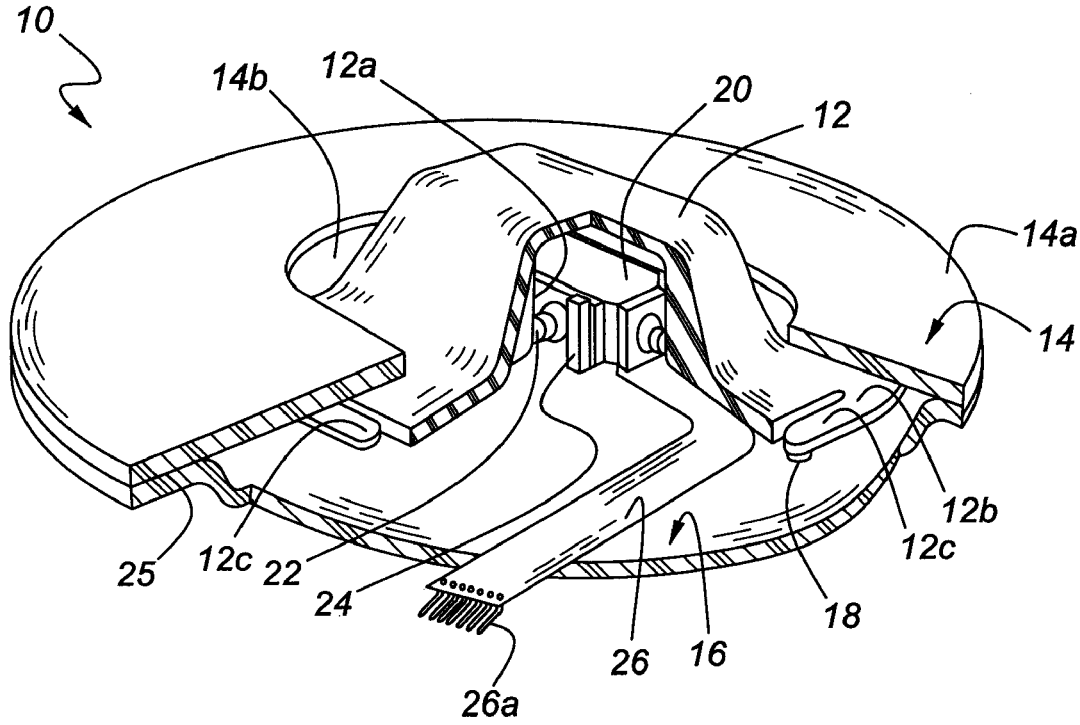
FIGS. 1A and 1B illustrate a switch in accordance with an embodiment of the present invention.
Figure 1B:
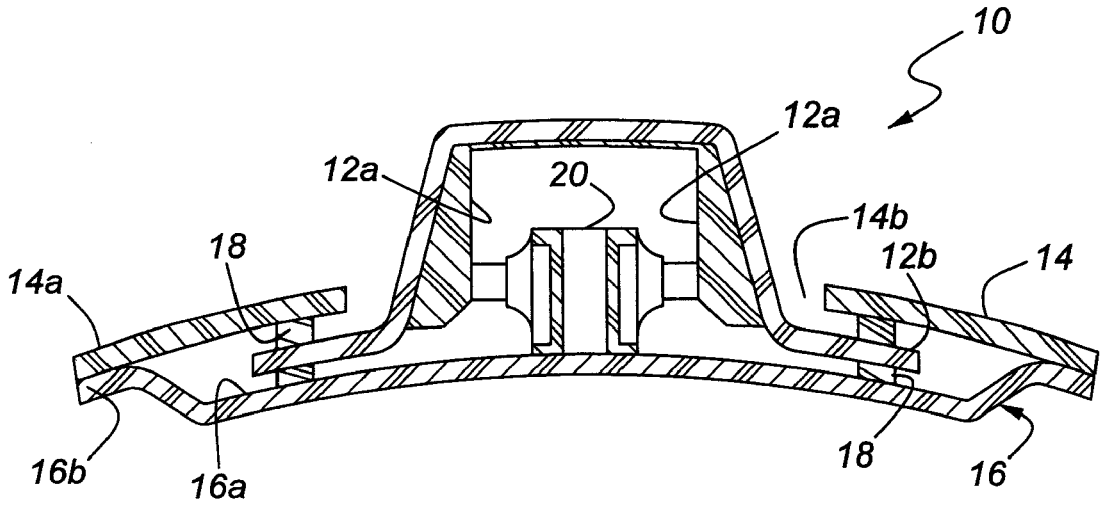

Referring to FIGS. 1A and 1B, a switch 10 is shown that includes a knob 12, a cover 14, and a base plate 16. Switch 10 may have a minimal thickness as compared to conventional switches. For example, knob 12 may have a width (e.g., the distance from cover 14 to base plate 16) of about eight millimeters. In one embodiment, knob 12 is configured to rotate about base plate 16. Alternatively, knob 12 may be configured to pivot from side-to-side in a similar manner as a conventional joystick, while being fixedly attached to base plate 16. Knob 12 includes an inner wall 12*a* having an electrically conductive surface. Rotation (or side-to-side movement) of knob 12 enables current (i.e., switch signals) to flow through switch 10 (including inner wall 12*a*). Knob 12 includes an outer perimeter 12*b*. In some embodiments, outer perimeter 12*b* has a finger 12*c* that extends outwardly. Finger 12*c* has a tension device 18 attached thereto. During rotation of knob 12, tension device 18 provides frictional feedback by restricting movement of knob 12. Alternatively, as shown in FIG. 1B, outer perimeter 12*b* includes tension devices 18 on a top and bottom side. It is recognized however, that some embodiments, depending upon the particular implementation, may or may not include tension devices 18.

Base plate 16 includes a lower portion 16*a* and an upper portion 16*b*. (FIG. 1B.) Base plate 16 may have a low friction surface to enable desired movement of knob 12 about base plate 16. Cover 14 includes an outer portion 14*a* and an opening 14*b*. A portion of knob 12 extends through opening 14*b* for user accessibility. Outer portion 14*a* of cover 14 is securely attached to upper portion 16*b* of base plate 16. (FIG. 1B.) An adhesive material 25 may be disposed between outer portion 14*a* and upper portion 16*b* so as to enable secure attachment of cover 14 to base plate 16.

As shown in FIG. 1A, a conductor 26 is integrated with base plate 16. Conductor 26 may be substantially planar with base plate 16 so as not to interfere with the rotation or movement of knob 12. In one embodiment, conductor 26 includes a flexible circuit formed of a suitable conductive material. In some embodiments, a discrete circuit device such as conductor 26 may not be required. In such an embodiment, base plate 16 may be a molded-interconnect device (MID) having at least one electrical line or track therein. With a MID base plate 16, the conductor(s) remains substantially planar with base plate 16 as the conductor is integrally formed or embedded within base plate 16. Such an embodiment may represent a three-dimensional printed circuit board. As recognized by one of ordinary skill in the art, MIDs include molded plastic devices having electrical conduits/tracks formed therein. For example, base plate 16 may be formed of a polybutylene terephthalate (PBT) or polypropylene (PP) material having doped metals therein that allow the flow of current. As also recognized by one of ordinary skill in the art, the electrical tracks may be formed in base plate 16 through processes such as laser direct structuring, two-shot molding and the like.

Figure 3:
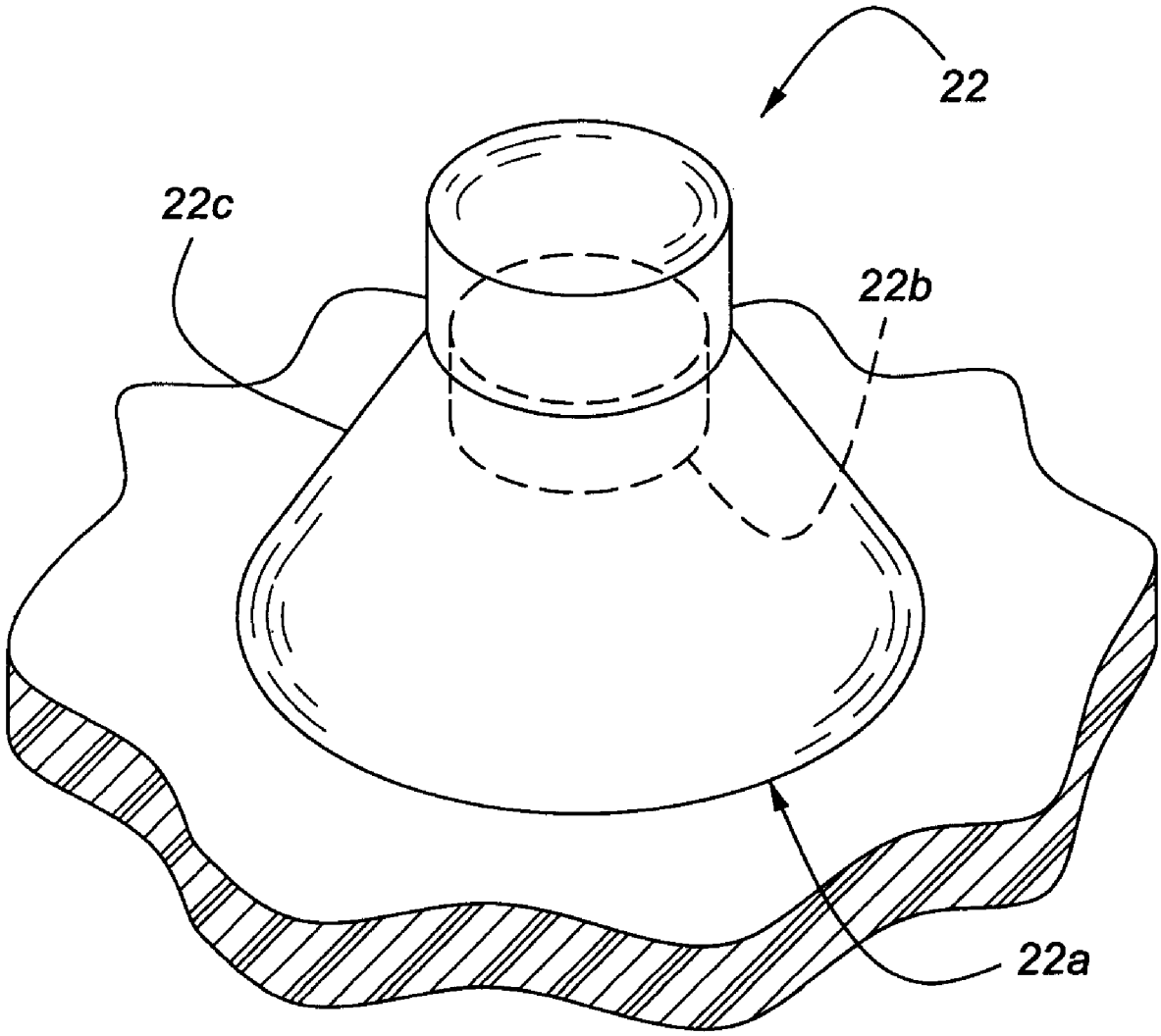
FIG. 3 illustrates an enlarged view of an electrical contact in accordance with an embodiment of the present invention.

Substantially enclosed within knob 12 may be a circuit support structure 20. Circuit support structure 20 includes at least one electrical contact 22 being attached thereto. FIG. 3 illustrates an enlarged view of electrical contact 22. Electrical contact 22 may have a compressible outer covering 22*c* that is formed of a suitable flexible material including, but not limited to rubber, plastic and the like. In one embodiment, outer covering 22*c* may be a silicone or rubber membrane. The exertion of pressure on knob 12 causes electrical contact 22 to be compressed against a portion of circuit support structure 20 causing switch signals to be transmitted. Accordingly, electrical contact 22 has an opening 22*b* that receives a conductive member 22*a*. Conductive member 22*a* may be formed of virtually any conductive material. When electrical contact 22 is compressed, conductive member 22*a* physically contacts the portion of the circuit support structure 20 that enables closing of a circuit and the flow of current.

In some embodiments, the silicone or rubber membrane (i.e., cover 12*c*) provides a recovery for the knob 12 when rotated or moved. For example, switch 10 may be designed to have pre-selected stopping points or positions for knob 12. Thus when knob 12 is rotated or moved the membrane may cause the knob 12 to spring into that desired position.

Circuit support structure 20 may be positioned on base plate 16 so as to electrically couple electrical contact 22 to conductor 26. Circuit support structure 20 may be stationary in reference to base plate 16. As shown in FIG. 1B, circuit support structure 20 may be securely positioned on a lower portion 16*a* of base plate 16. In one embodiment, a fixation member 24 extends from base plate 16 in close proximity to circuit support structure 20 so as to prevent undesirable movement of circuit support structure 20. Accordingly, as knob 12 is rotated or moved from side-to-side, the conductive inner wall 12*a* makes contact with electrical contact 22, thereby causing the transmission of switch signals across conductor 26 through leads 26*a* to other devices. In the event that base plate 16 is a MID, as recognized by one of ordinary skill in the art, base plate 16 may have a plurality of leads (e.g., leads 26*a*) that enable the transmission of switch signals to other devices.

Figure 2A:
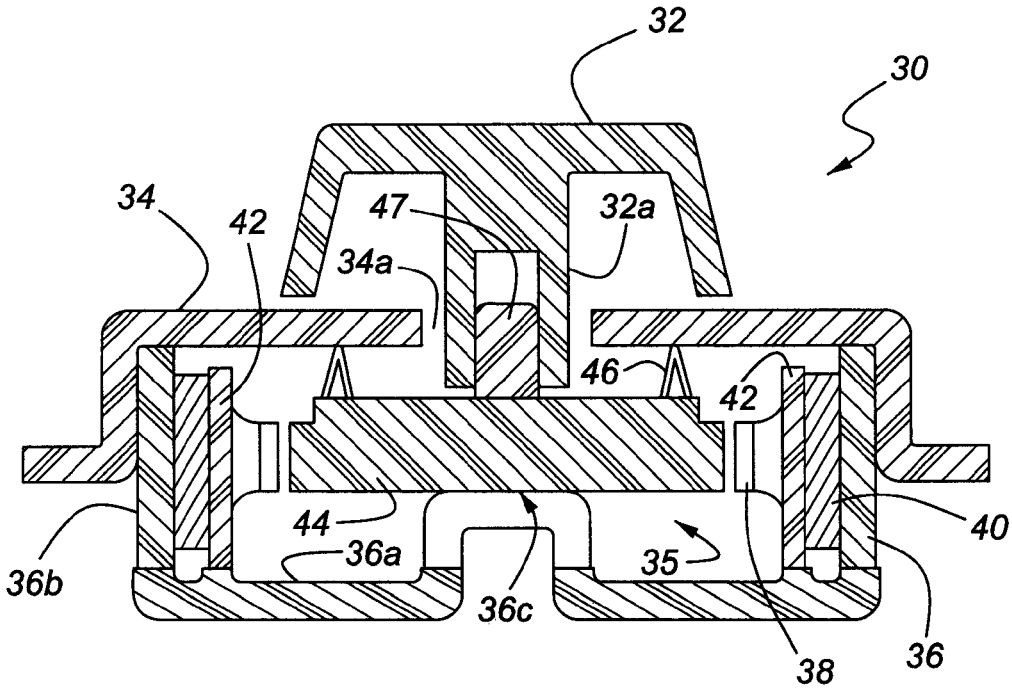
FIGS. 2A and 2B illustrate an alternative embodiment of a switch in accordance with an embodiment of the present invention.
Figure 2B:
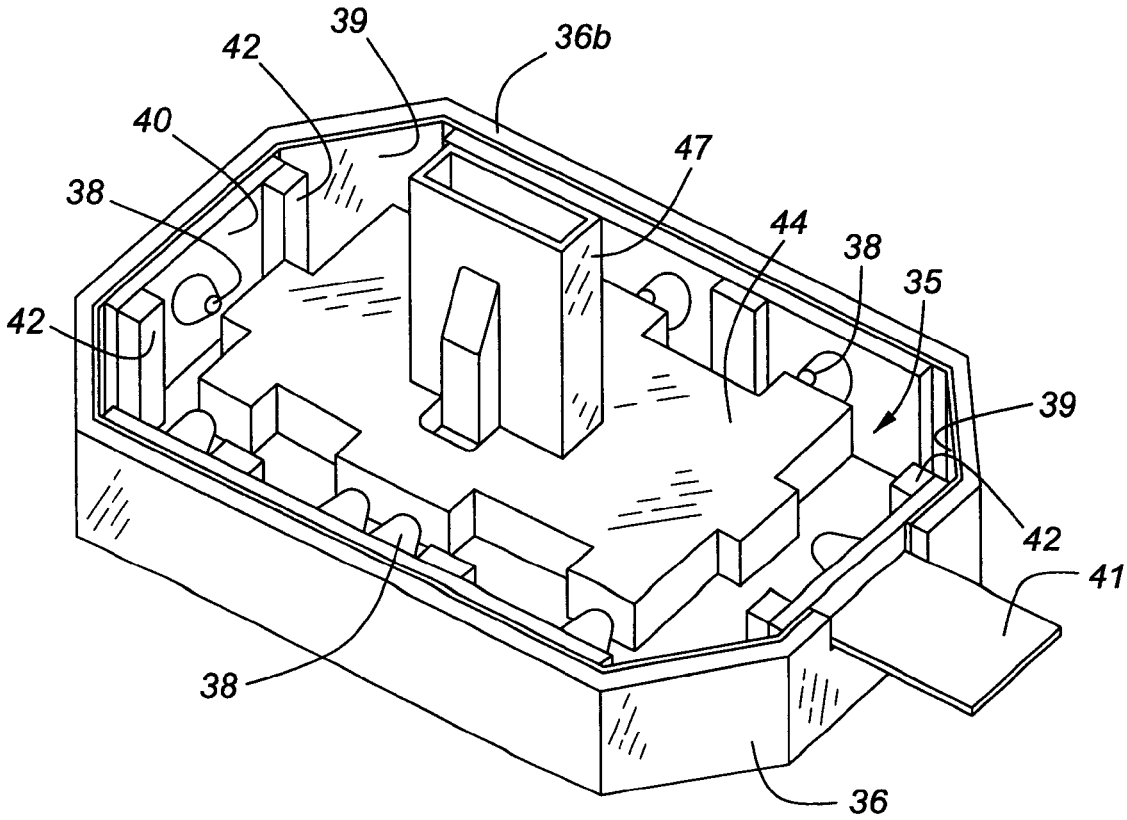

Now, referring to FIGS. 2A and 2B, an alternative embodiment of a switch (i.e, switch 30) is provided. Switch 30 includes a knob 32, a cover 34 and a housing 36. An actuator 44 is substantially enclosed within a cavity 35. Knob 32 is adapted to cause lateral movement of actuator 44 within housing 36. In some embodiments, actuation movement may be perpendicular to the switching surfaces of switch 30. It is recognized that switch 30 is merely an embodiment and not intended to serve as a limitation to the scope of the present invention.

Housing 36 includes a bottom wall 36*a* and a side wall 36*b*. Bottom wall 36*a* includes a raised surface 36*c*. In one embodiment (e.g., FIG. 2B), side wall 36*b* surrounds bottom wall 36*a* to form a cavity 35. As illustrated in FIG. 2A, cover 34 substantially covers bottom wall 36*a*.

Actuator 44 may be positioned on surface 36*c*. Without departing form the scope of the present invention, raised surface 36*c* may not be included in some embodiments. A mounting member 47 is attached or integrated with actuator 44. Mounting member 47 may be received by knob 32 via shaft 32*a* having an opening therein. Actuator 44 may be electrically conductive so as to enable the transmission of switch signals. In the embodiments shown in FIGS. 2A and 2B, actuator 44 is configured to laterally traverse bottom wall 36*a*. Traversal of bottom wall 36*a* enables actuator 44 to contact electrical contact 38 causing the transmission of switch signals.

Electrical contacts 38, which are similar to contact 22 of FIGS. 1A, 1B and 3, include a base 40 and is positioned within housing 36 via securing members 42. Securing members 42 extend upward from bottom wall 36*a*, as illustrated in FIGS. 2A and 2B. As shown, base 40 of electrical contact 38 is securely disposed between securing member 42 and side wall 36*b*.

In FIG. 2B, a conductor 39 is shown being substantially planar with side wall 36*b*. Conductor 39 may also be a flexible printed circuit adapted to be attached to side wall 36*b*. Alternatively, conductor 39 may be formed by way of side wall 36*b* being implemented as a MID. As described with regards to switch 10 (FIGS. 1A and 1B), side wall 36*b* may have one or more electrical lines or conductors formed therein. A circuit 41 may be a discrete conductor or a flexible circuit that extends from switch 30 to enable the transmission of switch signals to other devices.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A switch comprising:

a base plate;

a conductor being substantially planar with the base plate;

a circuit support structure positioned on the base plate in contact with the conductor;

a knob that substantially encloses the circuit support structure, the knob being moveable about the base plate so as to contact the circuit support structure during movement, and a cover having an opening through which the knob extends, the cover having an outer portion that is secured to the base plate.

2. The switch of claim 1, further comprising at least one electrical contact being attached to the circuit support structure, and wherein an inner wall of the knob is conductive, the at least one electrical contact being positioned on the circuit support structure and configured to contact the inner wall so as to cause transmission of a switch signal.

3. The switch of claim 1, further comprising at least one fixation member that extends from the base plate being securely positioned adjacent to the circuit support structure.

4. The switch of claim 3, wherein the knob includes at least one tension device located on an outer perimeter portion of the knob, the at least one tension device is configured to contact the base plate to restrict movement of the knob.

5. The switch of claim 4, wherein the outer perimeter portion includes an outward extending finger having the at least one tension device attached thereto.

6. The switch of claim 1, wherein the base plate includes an upper portion and a lower portion, wherein the outer portion is secured to the upper portion of the base plate; and wherein the circuit support structure is positioned on the lower portion of the base plate.

7. The switch of claim 6, wherein the outer portion is secured to the base plate through the use of an adhesive material; and wherein the knob being moveable about the base plate so as to contact the circuit support structure during movement includes the knob being rotatable about the base plate so as to contact the circuit support structure during rotation.

8. The switch of claim 1, wherein the conductor includes a flexible circuit.

9. The switch of claim 1, wherein the conductor being substantially planar with the base plate includes the base plate being a molded-interconnect device (MID) having at least one electrical line therein.

10. A switch comprising:

a housing having a bottom wall and at least one side wall being substantially perpendicular with the bottom wall;

an electrical conductor being substantially planar with the at least one side wall;

an actuator movably located within the housing and being configured to traverse the bottom wall of the housing; and at least one electrical contact being positioned within the housing and contacting the side wall to electrically couple the electrical contact and the electrical conductor, wherein traversal of the bottom wall by the actuator causes the actuator to contact the at least one electrical contact thereby causing the transmission of a switch signal.

11. The switch of claim 10, wherein the bottom wall includes a raised surface upon which the actuator is positioned.

12. The switch of claim 11, wherein the bottom wall is surrounded by the at least one side wall to form a cavity, the cavity having at least one securing member that extends from the bottom wall, wherein the at least one electrical contact is positioned within the housing by the securing member.

13. The switch of claim 10, wherein the conductor includes a flexible circuit, or wherein the conductor is substantially planar with the at least one side wall and wherein the at least one side wall is a molded-interconnect device (MID) having at least one electrical line therein.

14. The switch of claim 10, further comprising a cover having an opening and substantially covering the bottom wall.

15. The switch of claim 14, further comprising at least one support member that extends from the actuator to provide mechanical support for the cover.

16. The switch of claim 15, further comprising a knob having a shaft that extends through the opening and is securely positioned on the actuator.

17. A switch comprising:

a base plate;

a conductor being substantially planar with the base plate;

a circuit support structure securely positioned on the base plate through the use of multiple fixation rods that extend from the base plate, the circuit support structure being in contact with the conductor;

a knob that substantially encloses the circuit support structure, the knob having at least one tension device located on an outer perimeter portion of the knob, the at least one tension device making contact with the base plate to restrict movement of the knob, wherein the knob is rotatable about the base plate so as to encircle the circuit support structure during rotation;

at least one electrical contact being attached to the circuit support structure, wherein an inner wall of the knob is conductive and the electrical contact contacts the inner wall to cause transmission of a switch signal; and a cover having an opening through which the knob extends, the cover having an outer portion that is secured to the base plate.

18. The switch of claim 17, wherein the conductor being substantially planar with the base plate includes the conductor being a flexible circuit that is integrated with the base plate.

19. The switch of claim 17, wherein the conductor being substantially planar with the base plate includes the base plate being a molded-interconnect device (MID) having at least one electrical line therein.

* * * * *